US009788122B2

(12) United States Patent
Huang

(10) Patent No.: US 9,788,122 B2
(45) Date of Patent: Oct. 10, 2017

(54) VIBRATING PANEL DEVICE FOR ELECTROMAGNETIC VIBRATOR AND MANUFACTURE METHOD THEREOF

(71) Applicant: Xin Min Huang, Ningbo (CN)

(72) Inventor: Xin Min Huang, Ningbo (CN)

( * ) Notice: Subject to any disclaimer, the term of this patent is extended or adjusted under 35 U.S.C. 154(b) by 0 days.

(21) Appl. No.: 15/076,607

(22) Filed: Mar. 21, 2016

(65) Prior Publication Data

US 2016/0205476 A1 Jul. 14, 2016

Related U.S. Application Data

(62) Division of application No. 13/806,949, filed on Dec. 26, 2012, now Pat. No. 9,351,078.

(51) Int. Cl.

| | |
|---|---|
| ***H04R 7/06*** | (2006.01) |
| ***H04R 31/00*** | (2006.01) |
| ***H04R 9/04*** | (2006.01) |
| ***H04R 9/06*** | (2006.01) |
| *H04R 1/28* | (2006.01) |

(52) U.S. Cl.

CPC ..... *H04R 7/06* (2013.01); *H04R 9/046* (2013.01); *H04R 9/06* (2013.01); *H04R 31/003* (2013.01); *H04R 31/006* (2013.01); *H04R 1/283* (2013.01); *H04R 2231/001* (2013.01); *H04R 2231/003* (2013.01); *H04R 2307/204* (2013.01)

(58) Field of Classification Search

CPC ... H04R 7/02; H04R 7/04; H04R 7/16; H04R 7/18; H04R 7/20; H04R 9/04; H04R 9/041; H04R 9/045; H04R 9/046; H04R 2231/001; H04R 2231/003; H04R 2307/201; H04R 2307/204; H04R 2307/207

See application file for complete search history.

(56) References Cited

U.S. PATENT DOCUMENTS 3,997,023 A * 12/1976 White ..... G10K 13/00 181/171
4,928,312 A * 5/1990 Hill ..... H04R 1/025 181/174
5,455,396 A * 10/1995 Willard ..... H04R 7/20 181/172
5,521,886 A * 5/1996 Hirosawa ..... B29C 45/1639 29/594

(Continued)

*Primary Examiner* — Joshua Kaufman

(74) *Attorney, Agent, or Firm* — Raymond Y. Chan; David and Raymond Patent Firm

(57) ABSTRACT

The present invention includes a vibrating panel device for an electromagnetic vibrator, which includes at least one vibrating panel device. The vibrating panel module includes a base, a vibrating panel and an upper suspension, wherein an inner edge and an outer edge of the upper suspension are respectively connected with the base and the vibrating panel, and form an integrated whole body. Further, two vibrating panel modules are fixedly connected in opposite directions to form the vibrating panel device. By unique structures of the vibrating panel device, when the voice coil drives the vibrating panel to actuate, shaking of the vibrating panels is offset due to interactions between a pair of the suspensions and a pair of the vibrating panels, in such a manner that the voice coil drives the vibrating panel to process vertical up-and-down stroke, so as to replace a conventional damper.

16 Claims, 6 Drawing Sheets

(56) References Cited

U.S. PATENT DOCUMENTS 5,892,184 A * 4/1999 D'Hoogh ..... H04R 1/2834 181/156
6,160,898 A * 12/2000 Bachmann ..... H04R 7/045 381/398
6,171,534 B1 * 1/2001 Leach ..... B29C 45/14336 264/102
6,224,801 B1 * 5/2001 Mango, III ..... B29C 45/14336 264/154
6,490,363 B1 * 12/2002 Liu ..... H04R 9/06 381/398
6,543,574 B1 * 4/2003 Mizone ..... H04R 7/20 181/171
6,675,931 B2 * 1/2004 Sahyoun ..... H04R 7/20 181/144
6,895,097 B2 * 5/2005 Furuyama ..... H04R 7/20 181/171
7,428,946 B2 * 9/2008 Honda ..... H04R 7/18 181/163
7,505,603 B2 * 3/2009 Yoo ..... H04R 1/06 381/398
8,442,259 B2 * 5/2013 Williamson ..... H04R 7/16 381/398
8,705,790 B2 * 4/2014 Kuze ..... H04R 7/20 381/398
9,025,808 B2 * 5/2015 Kwon ..... H04R 9/043 381/398
9,027,700 B2 * 5/2015 Kim ..... H04R 7/02 181/171
9,107,002 B2 * 8/2015 Fujitani ..... H04R 7/127
9,351,078 B2 * 5/2016 Huang ..... H04R 7/08
2002/0121403 A1 * 9/2002 Sahyoun ..... H04R 7/20 181/157
2003/0188919 A1 * 10/2003 Suzuki ..... H04R 7/20 181/171
2006/0025179 A1 * 2/2006 Kim ..... H04M 1/6041 455/569.1
2006/0110001 A1 * 5/2006 Saint Vincent ..... H04R 7/20 381/396
2007/0071274 A1 * 3/2007 Andersen ..... H04R 1/06 381/404
2008/0080736 A1 * 4/2008 Sumitani ..... H04R 9/043 381/407
2010/0220888 A1 * 9/2010 Huang ..... H04R 31/006 381/400
2010/0322458 A1 * 12/2010 Takewa ..... H04R 7/02 381/398
2011/0002484 A1 * 1/2011 Hama ..... B06B 1/0607 381/152
2011/0064260 A1 * 3/2011 Andersen ..... H04R 7/20 381/430
2011/0228949 A1 * 9/2011 Haba ..... H04R 1/028 381/86
2012/0160598 A1 * 6/2012 Silver ..... H04R 7/20 181/172
2012/0237076 A1 * 9/2012 Kuze ..... H04R 7/20 381/387
2013/0064413 A1 * 3/2013 Cazes Bouchet ..... H04R 7/04 381/396
2013/0070953 A1 * 3/2013 Dodd ..... H04R 7/02 381/398
2013/0259291 A1 * 10/2013 Fujitani ..... H04R 7/127 381/423
2014/0169593 A1 * 6/2014 Kwon ..... H04R 9/043 381/185
2014/0318885 A1 * 10/2014 Kim ..... H04R 7/02 181/171
2015/0208172 A1 * 7/2015 Kim ..... H04R 7/02 381/398

* cited by examiner

VIBRATING PANEL DEVICE FOR ELECTROMAGNETIC VIBRATOR AND MANUFACTURE METHOD THEREOF

CROSS REFERENCE OF RELATED APPLICATION

This is a Divisional application that claims the benefit of priority under 35 U.S.C. §119 to a non-provisional application, application Ser. No. 13/806,949, filed Dec. 26, 2012, which is a U.S. National Stage non-provisional application under 35 U.S.C. 371 of the International Application PCT/CN2012/073917, filed Apr. 12, 2012, that claims priority under 35 U.S.C. 119(a-d) to CN 201110132477.1, filed May 19, 2011; CN 201120164230.3, filed May 19, 2011; CN 201210082195.X, filed Mar. 26, 2012; and CN 201220117869.0, filed Mar. 26, 2012.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention mainly relates to an electromagnetic vibrating device, and more particularly to a vibrating panel device which utilizes a pair of vibrating panel modules buckled in opposite sides and fixed, or utilizes an upper suspension and a lower suspension in opposite directions which are respectively connected and fixed with upper and lower surfaces of a vibrating panel and a base, so as to replace functions of a conventional damper, and its manufacture method.

Description of Related Arts

It is well known that electromagnetic vibrator, also called loudspeaker and commonly known as horn speaker, is a kind of electro-acoustic device converting electrical energy into acoustic energy. A process for manufacturing conventional loudspeakers comprises steps of: bonding a T-yoke or a U-yoke, bonding a cone frame and a magnetic circuit, installing a terminal, installing a damper, inserting a voice coil, installing a cone paper suspension and etc. Firstly, the required elements are prepared, and then manufacturing is processed from top to bottom and from inside out by hand. The damper, also called spider, is a main element in a paper-cone loudspeaker vibrating system. The damper is a corrugated type circular ring which is made by processing hot-pressing on materials of cotton cloth, silk, glass cloth and etc. which are soaked in phenolic resin. The main effects of the damper are as following.

(1) Maintains the proper position of the voice coil in a magnet gap, which requires the damper to have great compliance in an axial direction, in such a manner that the voice coil is capable of vibrating vertically in the magnet gap; and requires the damper to be capable of restricting left-right movement of the voice coil reliably, in such a manner that the voice coil is not in contact with the washer and the T-yoke.

(2) The damper, which is a supporting element, provides the loudspeaker with a restoring force and influences the mechanical Q factor, i.e., the damping characteristic, of the loudspeaker.

(3) The damper, the paper cone and the voice coil together determine the resonance the frequency of the loudspeaker. [0009] (4) The damper of a compound-edge loudspeaker serves as a buffer and a mechanical amplitude limiter.

Based on the effects of the damper mentioned above, in conventional loudspeakers, an inner ring of the damper is fixedly connected with the voice coil and an outer ring surface of the damper needs to be fixedly connected with a base frame of the loudspeaker, which limits the thickness of the loudspeaker to a certain extent.

However, with the development of society and the continuously improvement of people's living standard, people not only require electronic products, such as LCD TV (Liquid Crystal Display Television), lap-top computer and mobile phone, to have low thickness, but also concern the sound quality of the electronic products. Referring to FIG. 1 of the drawings, when an ordinary loudspeaker is applied to these electronic products, the thickness of the loudspeaker is limited due to the effect of the structures of conventional loudspeakers, wherein the most common structure is a cone-shape or arc-shape vibrating cone paper bonded to a fiber damper which is soaked in resin. For the conventional loudspeakers to maintain a round-trip stroke, a conventional ring shaped damper is boned with a voice coil, then the voice coil is boned with conventional cone paper, further the cone paper is bonded with a suspension. By gluing an inner connecting surface of the damper, the voice coil is fixedly mounted on a middle portion of the magnetic circuit system; an outer connecting surface of the damper is fixedly mounted on the base of the loudspeaker by gluing as well. An inner edge of the vibrating cone paper of the loudspeaker is also fixed with the voice coil by gluing; an outer edge of the vibrating cone paper is fixedly mounted on the base frame of the loudspeaker by gluing the suspension thereon. In the integrated loudspeaker, the damper and the suspension support and fix the suspension system of the entire loudspeaker. Thus, due to the conventional shape of the vibrating cone paper and the suspension and due to structures of the conventional damper, the structure of the conventional damper is influenced and can not be thinned. When the whole loudspeaker is operating up-and-down piston movement, the suspension and the damper operate axial movements, both the suspension and the damper are fixed on the cone frame, i.e., base frame, of the loudspeaker. The suspension is on the top edge of the base frame, and the damper is on the bottom of the base frame. Especially when high-power is inputted, the up-and-down motion amplitude increases, and the effect caused by different manufacture materials of the suspension and the damper exists, so that the entire suspension system is hard to operate up-and-down movement in a straight line, which probably leads to collision between the voice coil and the magnetic circuit system when the voice coil is moving. Further, the application of conventional damper limits thickness of the loudspeaker, and the loudspeaker is not capable of reaching requirements of the electronic products. In addition, as time goes by, aging or degumming will appear on the glue, which causes that the sound quality of the loudspeaker changes or the whole loudspeaker damages.

Furthermore, from the appearance point of view, the passive radiator enclosure on the currently market has two loudspeakers. In fact one of the loudspeakers thereof is "fake". The "fake" loudspeaker only has a suspension and a vibrating panel mounted on the box body thereof and is not capable of working independently. The "fake" loudspeaker is actually just an auxiliary vibrator whose operation is driven by the sound wave generated by the operation of the other loudspeaker, so as to achieve better sound quality. However, since the auxiliary vibrator only has one suspension to fix the vibrating panel, the stroke of the vibrating panel is easy to be unbalanced, so that noise is generated and the sound quality is reduced.

SUMMARY OF THE PRESENT INVENTION

A main object of the present invention is to provide a vibrating panel device for an electromagnetic vibrator which comprises at least one vibrating panel module. The vibrating panel module comprises a base, a vibrating panel and an upper suspension, wherein an inner edge and an outer edge of the upper suspension are respectively connected with the base and the vibrating panel to form an integrated whole body. Further, a pair of the vibrating panel modules are fixedly connected in opposite directions to form the vibrating panel device. By means of unique structures of the vibrating panel device, when the voice coil drives the vibrating panel to actuate, shaking of the vibrating panels while actuating is offset due to interactions between a pair of the suspensions and a pair of the vibrating panels, in such a manner that the voice coil drives the vibrating panel to process vertical up-and-down stroke, so as to replace a conventional damper A second object of the present invention is to provide a manufacture method of a vibrating panel device for an electromagnetic vibrator which comprises the steps of:

putting the upper suspension and the vibrating panel into a base mold, integrating into a whole body by insert molding to form the vibrating panel module; and fixedly buckling a pair of the vibrating panel modules in opposite sides.

The vibrating panel device for the electromagnetic vibrator of the present invention relies entirely on special designing of industrial structure and unique manufacture process to replace application of glue, so as to achieve an object of improving product quality and product qualification ratio.

A third object of the present invention is to provide a vibrating panel device for an electromagnetic vibrator. When the vibrating panel device is applied in a passive radiator enclosure to serve as an auxiliary vibrator, the vibrating panel is ensured to process vertical and balanced up-and-down stroke better by unique structure.

Accordingly, in order to accomplish the above objects, technical solutions adopted by the present invention are as following. A vibrating panel device for an electromagnetic vibrator is provided, which comprises at least one vibrating panel module, wherein the vibrating panel module comprises a base, a vibrating panel and an upper suspension, wherein the base has:

an inner surface which circles inside the base, so as to form a through hole;

at least one connecting portion provided on a periphery of a bottom of the base for fixedly mounting a peripheral cone frame of the electromagnetic vibrator;

a first button mounted on a first side of a bottom of the base, and a first button hole mounted on a second side of a bottom of the base for coupling with the first button, in such a manner that when a pair of the vibrating panel modules are adopted, by rotating one vibrating panel module thereof for 180 degrees, the first button and the first button hole are fixedly buckled to form the vibrating panel device.

In addition, the vibrating panel is provided on a middle portion of the through hole on the base, and has an upper surface and a lower surface. A second button and a second button hole are provided on the lower surface of the vibrating panel. The second button is mounted on a first side of a lower surface of the vibrating panel, the second button hole is provided on a second side of the lower surface of the vibrating panel for coupling with the second button, in such a manner that when a pair of the vibrating panel modules are adopted, by rotating a vibrating panel module thereof for 180 degrees, the second button and the second button hole are buckled to firmly bond the pair of the vibrating panel modules together.

Further, an inner edge of the upper suspension is fixedly connected with a periphery of the upper surface of the vibrating panel, and an outer edge of the upper suspension is mounted on the base.

It is worth mentioning that, the vibrating panel device is formed by the vibrating panel module and a lower suspension. The lower suspension and the upper suspension are in opposite directions. An inner edge of the lower suspension is fixedly connected with a periphery of the lower surface of the vibrating panel, and an outer edge of the lower suspension is mounted on the base.

It is worth mentioning that when the vibrating panel device is applied to an electromagnetic vibrator, an electromagnetic vibrator comprises a vibrating panel device, a voice coil, a magnetic circuit system and a peripheral cone frame, wherein a first end of the voice coil is fixedly provided on a voice coil mounting portion on a lower surface of the vibrating panel, a second end of the voice coil is provided inside the magnetic circuit system; a first end of the peripheral cone frame is fixedly connected with the magnetic circuit system, and a second end of the peripheral cone frame is fixedly connected with the connecting portion on the base, in such a manner that an integrated whole body is formed.

It is worth mentioning that when the vibrating panel device is applied to a loudspeaker box to serve as an auxiliary vibrator, the vibrating panel device is fixed on an auxiliary vibrator mounting portion on a body of the loudspeaker box, in such a manner that acoustic wave generated by the loudspeaker while working drives the vibrating panel device to vibrate vertically up-and-down with balanced amplitude.

Further, a manufacture method of a vibrating panel device for an electromagnetic vibrator is provided which comprises the steps of:

(a) putting the upper suspension and the vibrating panel into a base mold, integrating by insert molding to form the vibrating panel;

(b) mounting a pair of the vibrating panel modules in opposite directions, so as to form the vibrating panel device.

Beneficial effects of the present invention are as following.

A vibrating panel device for an electromagnetic vibrator is provided, which comprises at least one vibrating panel module. The vibrating panel module comprises a base, a vibrating panel and an upper suspension, wherein an inner edge and an outer edge of the upper suspension are respectively connected with the base and the vibrating panel, and form an integrated whole body. Further, two of the vibrating panel modules are fixedly connected in opposite directions to form the vibrating panel device. By means of unique structures of the vibrating panel device, when the voice coil drives the vibrating panel to actuate, shaking of the vibrating panels while actuating is offset due to interactions between a pair of the suspensions and a pair of the vibrating panels, in such a manner that the voice coil drives the vibrating panel to process vertical up-and-down stroke, so as to replace a conventional damper.

In addition, when the vibrating panel device is applied in a passive radiator enclosure to serve as an auxiliary vibrator, by application of the upper suspension and the lower suspension, the vibrating panel is ensued to process vertical and balanced up-and-down stroke better.

Further, a manufacture method of a vibrating panel device for an electromagnetic vibrator is provided, which comprises the steps of:

putting the upper suspension and the vibrating panel into a base mold, integrating by insert molding to form the vibrating panel module; and fixedly mounting a pair of the vibrating panel module in opposite directions, so as to form the vibrating panel device.

The vibrating panel device for the electromagnetic vibrator of the present invention relies entirely on special designing of industrial structure and unique manufacture process to replace application of glue, so as to achieve an object of improving product quality and product qualification ratio.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
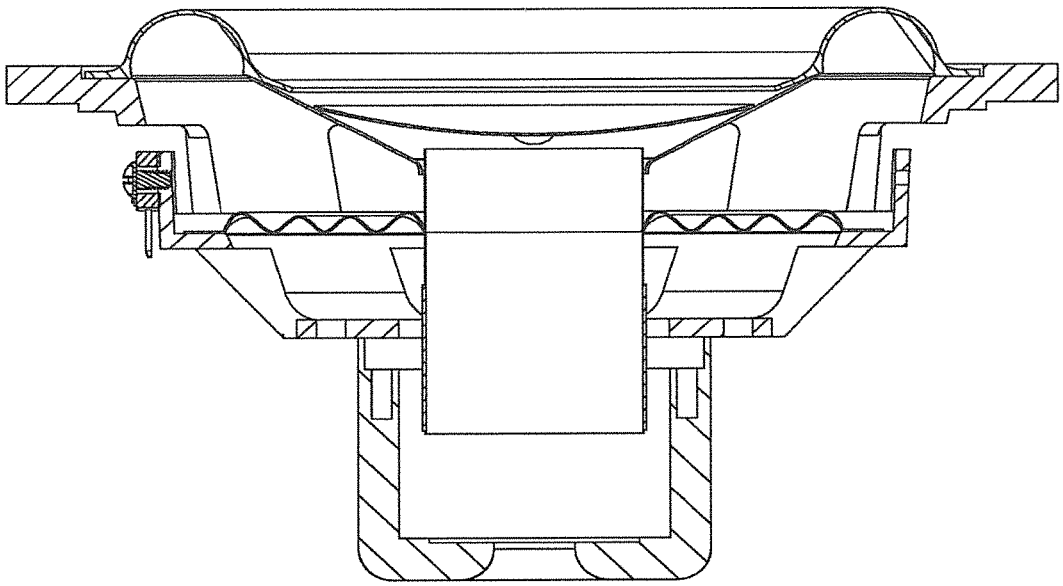
Fig. 1 Prior art
FIG. 1 is a sectional view of a conventional electromagnetic vibrating device.
Figure 2:
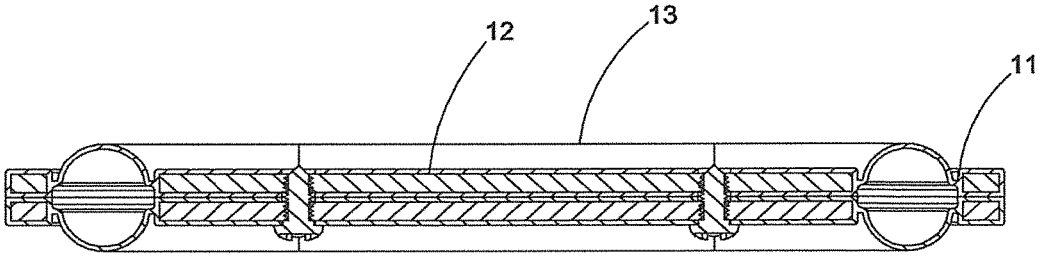
FIG. 2 is a block schematic view according to a first preferred embodiment of the present invention.
Figure 3:
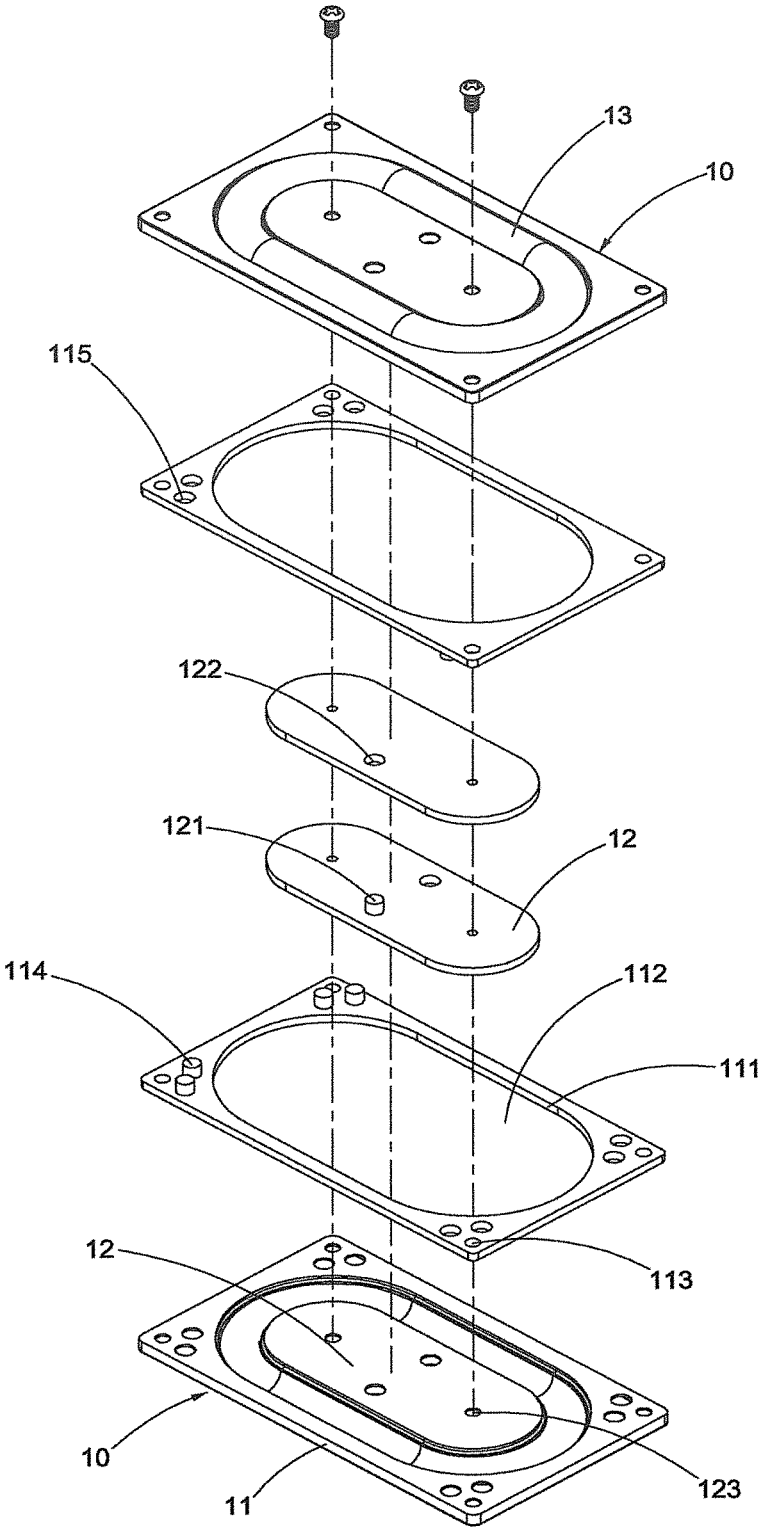
FIG. 3 is a sectional view according to the first preferred embodiment of the present invention.

Referring to FIG. 2 and FIG. 3 of the drawings, a vibrating panel device for an electromagnetic vibrator according to a first embodiment of the present invention comprises at least one vibrating panel module 10, wherein the vibrating panel module 10 comprises a base 11, a vibrating panel 12 and an upper suspension 13, wherein the base 11 has:

an inner surface 111 which circles inside the base 11, so as to form a through hole 112;

at least one connecting portion 113 provided on a periphery of a bottom of the base 11 for mounting a peripheral cone frame of the electromagnetic vibrator;

a first button 114 mounted on a first side of a bottom of the base 11; and a first button hole 115 mounted on a second side bottom of the base 11 for coupling with the first button 114, in such a manner that when a pair of the vibrating panel modules 10 are adopted, by rotating one vibrating panel module thereof for 180 degrees, the first button 114 and the first button hole 115 are fixedly buckled to form the vibrating panel device.

In addition, the vibrating panel 12 is provided on a middle portion of the through hole 112 on the base 11. The vibrating panel 12 has a second button 121 and a second button hole 122. The second button 121 is mounted on a first side of a lower surface of the vibrating panel 12, the second button hole 122 is provided on a second side of a lower surface of the vibrating panel 12 for coupling with the second button 121, in such a manner that when a pair of the vibrating panel modules 10 are adopted, by rotating one vibrating panel module thereof for 180 degrees, the second button 121 and the second button hole 122 are buckled to firmly bond the pair of the vibrating panel modules together.

Further, at least one mounting hole 123 is provided on the vibrating panel 12, in such a manner that when a pair of the vibrating panel module are adopted, the vibrating panels 12 of the pair of the vibrating panel modules 10 are better mounted via the mounting hole 123 in manners of locking screw and etc.

In addition, an inner edge of the suspension 13 is mounted on a periphery of an upper surface of the vibrating panel 12, and an outer edge of the suspension 13 is fixedly provided on the base 11.

It is worth mentioning that when the vibrating panel device is applied to an electromagnetic vibrator, an electromagnetic vibrator comprises a vibrating panel device, a voice coil, a magnetic circuit system and a peripheral cone frame, wherein a first end of the voice coil is fixedly provided on a voice coil mounting portion on a lower surface of the vibrating panel, a second end of the voice coil is provided in the magnetic circuit system; a first end of the peripheral cone frame is fixedly connected with the magnetic circuit system, a second end of the peripheral cone frame is fixedly connected with the connecting portion on the base, in such a manner that the whole electromagnetic vibrator is formed.

It is worth mentioning that by means of unique structures mentioned above, when the voice coil drives the vibrating panel to actuate, shaking of the vibrating panels while actuating is offset due to interactions between a pair of the suspensions and a pair of the vibrating panels, in such a manner that the voice coil drives the vibrating panel to process vertical up-and-down stroke.

Figure 6:
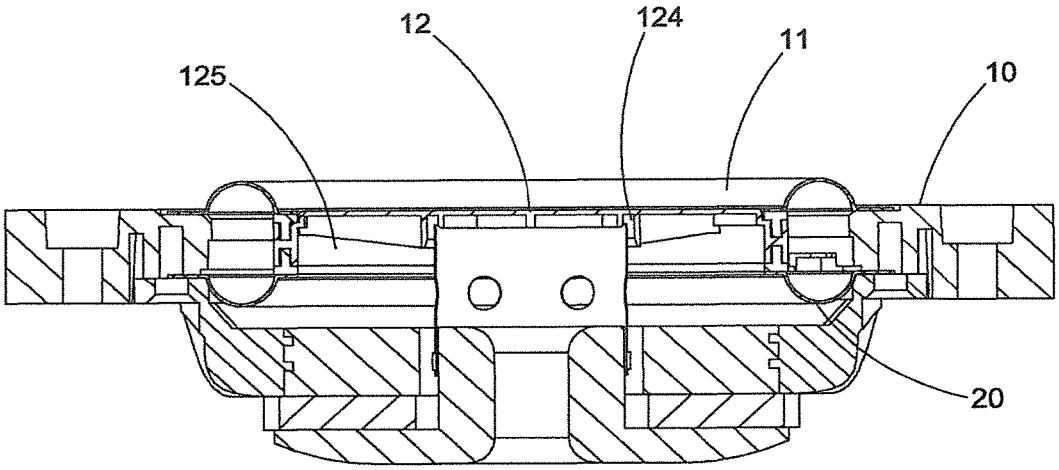
FIG. 6 is a schematic view according to preferred embodiments of the present invention, showing a vibrating device of the present invention serves as an auxiliary vibrator.

Referring to FIG. 6 of the drawings, it is worth mentioning that when the vibrating panel device is applied to a loudspeaker box to serve as an auxiliary vibrator, the vibrating panel device is mounted on an auxiliary vibrator mounting portion on a body of the loudspeaker box, in such a manner that acoustic wave generated by the loudspeaker while working drives the vibrating panel device to vibrate vertically and up-and-down with equal amplitude better.

Further, a manufacture method of a vibrating panel device for an electromagnetic vibrator is provided and comprises the steps of: [0062] (a) putting the upper suspension and the vibrating panel into a base mold, integrating by insert molding to form a whole body, in such a manner that the vibrating panel module is formed; [0063] (b) mounting a pair of the vibrating panel module in opposite sides, so as to form the vibrating panel device.

A second preferred embodiment of the present invention is as following.

Figure 4:
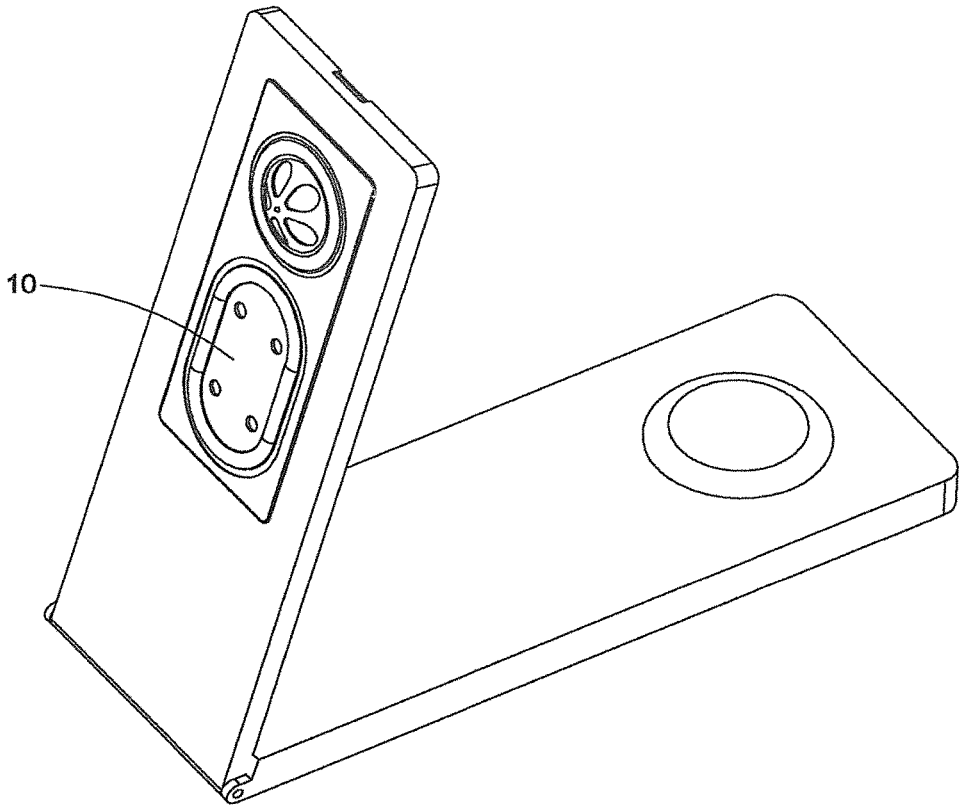
FIG. 4 is a bottom view according to a second preferred embodiment of the present invention.
Figure 5:
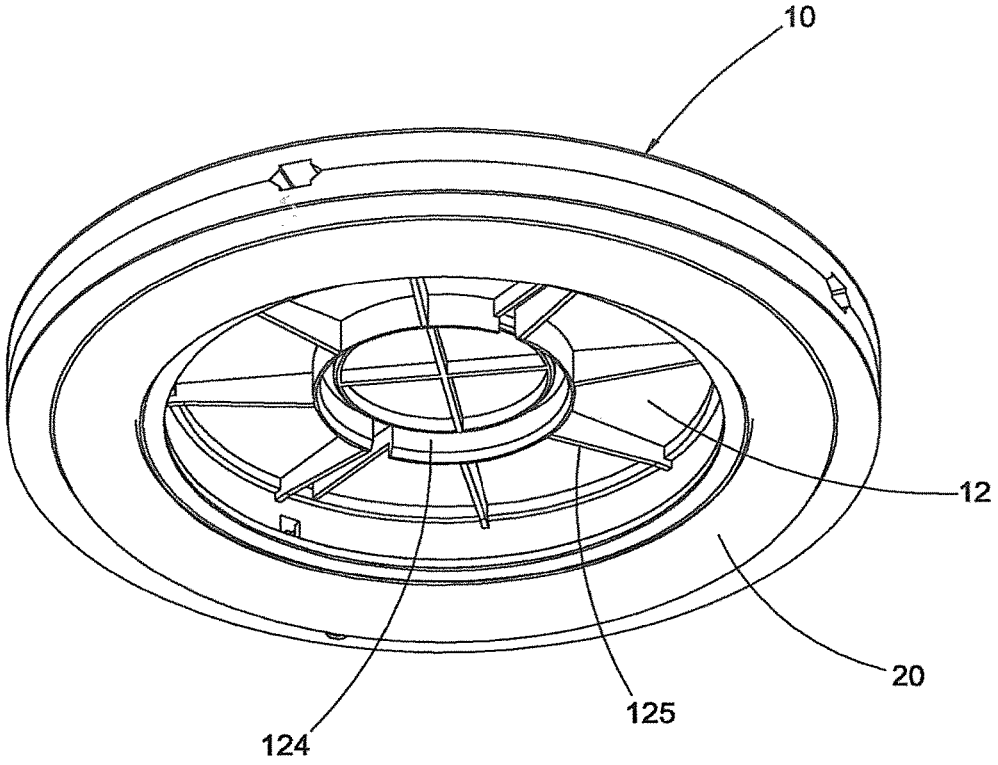
FIG. 5 is a sectional view according to the second preferred embodiment of the present invention.

Referring to FIG. 4 and FIG. 5 of the drawings, a vibrating panel device for an electromagnetic vibrator is formed by the vibrating panel module 10 mentioned above and a lower suspension 20, wherein the lower suspension 20 and the upper suspension 13 of the vibrating panel 10 are in opposite directions, wherein an inner edge of the lower suspension is fixedly connected with a periphery of a lower surface of the vibrating panel 12, and an outer edge of the lower suspension is fixedly provided on the base 11.

Further, a voice coil mounting portion 124 is provided on a middle portion of a lower surface of the vibrating panel 12 for mounting an end of the voice coil of the electromagnetic vibrator onto the vibrating panel 12.

Further, a plurality of reinforcing ribs 125 are uniformly provided on the vibrating panel 12. The reinforcing ribs 125 uniformly and radically extend to periphery around the voice coil mounting portion 124, in such a manner that the vibrating panel 12 process vertical up-and-down stroke better while working.

Preferably, the voice coil mounting portion 124 is a groove which circles around a central point of the lower surface of the vibrating panel, for inserting and mounting an end of the voice coil of the electromagnetic vibrator onto the vibrating panel 12.

Preferably, the voice coil mounting portion 124 is a voice coil tray (not shown in the drawings) which is in a shape of a convex, a bottom of the voice coil tray is bonding fixed with a middle portion of a lower surface of the vibrating panel, a top of the voice coil tray is inserted by an end of voice coil and is bonded to fix the voice coil, so as to increase an area of a connection surface between the voice coil and the vibrating panel, in such a manner that the voice coil and the vibrating panel are better mounted.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A vibrating panel device for an electromagnetic vibrator, comprising at least a pair of first and second vibrating panel modules, wherein said first vibrating panel module comprises a first base, a first vibrating panel and a first suspension, wherein an inner edge and an outer edge of said first suspension are respectively connected with said first vibrating panel and said first base so as to form an integrated whole body, wherein said second vibrating panel module comprises a second base, a second vibrating panel and a second suspension, wherein an inner edge and an outer edge of said second suspension are respectively connected with said second vibrating panel and said second base so as to form an integrated whole body, wherein said pair of first and second vibrating panel modules is fixedly connected in opposite directions by inverting one of said first and second vibrating panel modules to couple said first base and said second base with each other, while said first suspension and second suspension are oriented in opposite directions, to form said vibrating panel device, wherein each of said first and second bases comprises a button and a button hole, wherein when said buttons are coupled with said button holes, said first and second bases are coupled with each other.

2. The vibrating panel device, as recited in claim 1, wherein said first and second vibrating panels are rigid panels and said first and second suspension are made of flexible material, wherein said first suspension is molded-injected between said first base and said first vibrating panel that said first suspension is integrally extended from said first base to said first vibrating panel to cover on an upper surface of said first base and an upper surface of said first vibrating panel to form the integrated whole body, wherein said second suspension is molded-injected between said second base and said second vibrating panel that said second suspension is integrally extended from said second base to said second vibrating panel to cover on an upper surface of said second base and an upper surface of said second vibrating panel to form the integrated whole body.

3. The vibrating panel device, as recited in claim 2, wherein said button is mounted on a first side bottom of each of said first and second bases, and said button hole is mounted on a second side bottom of each of said first and second bases, which is opposite to said first side bottom surface for coupling with said button, in such a manner when a pair of said first and second vibrating panel modules is coupled, by rotating one of said first and second vibrating panel modules for 180 degrees, said buttons and said button holes are fixedly coupled.

4. The vibrating panel device, as recited in claim 3, wherein at least one mounting hole is provided on each of said first and second vibrating panels, wherein when a pair of said first and second vibrating panel modules is coupled, said first and second vibrating panels on said pair of first and second vibrating panel modules are mounted via said mounting holes by locking screws respectively.

5. The vibrating panel device, as recited in claim 1, wherein said button is mounted on a first side bottom of each of said first and second bases, and said button hole is mounted on a second side bottom of each of said first and second bases, which is opposite to said first side bottom surface for coupling with said button, in such a manner when a pair of said first and second vibrating panel modules is coupled, by rotating one of said first and second vibrating panel modules for 180 degrees, said buttons and said button holes are fixedly coupled.

6. The vibrating panel device, as recited in claim 5, wherein at least one mounting hole is provided on each of said first and second vibrating panels, wherein when a pair of said first and second vibrating panel modules is coupled, said first and second vibrating panels on said pair of first and second vibrating panel modules are mounted via said mounting holes by locking screws respectively.

7. The vibrating panel device, as recited in claim 1, wherein at least one mounting hole is provided on each of said first and second vibrating panels, wherein when a pair of said first and second vibrating panel modules is coupled, said first and second vibrating panels on said pair of first and second vibrating panel modules are mounted via said mounting holes by locking screws respectively.

8. A vibrating panel device for an electromagnetic vibrator, comprising at least a pair of first and second vibrating panel modules, wherein said first vibrating panel module comprises a first base, a first vibrating panel and a first suspension, wherein an inner edge and an outer edge of said first suspension are respectively connected with said first vibrating panel and said first base so as to form an integrated whole body, wherein said second vibrating Panel module comprises a second base, a second vibrating panel and a second suspension, wherein an inner edge and an outer edge of said second suspension are respectively connected with said second vibrating Panel and said second base so as to form an integrated whole body, wherein said pair of first and second vibrating panel modules is fixedly connected in opposite directions by inverting one of said first and second vibrating panel modules to couple said first base and said second base with each other, while said first suspension and second suspension are oriented in opposite directions, to form said vibrating panel device;

wherein said first and second vibrating Panels are rigid panels and said first and second suspension are made of flexible material, wherein said first suspension is molded-injected between said first base and said first vibrating panel that said first suspension is integrally extended from said first base to said first vibrating panel to cover on an upper surface of said first base and an upper surface of said first vibrating panel to form the integrated whole body, wherein said second suspension is molded-injected between said second base and said second vibrating panel that said second suspension is integrally extended from said second base to said second vibrating panel to cover on an upper surface of said second base and an upper surface of said second vibrating panel to form the integrated whole body;

wherein at least one mounting hole is provided on each of said first and second vibrating panels, wherein when a pair of said first and second vibrating panel modules is coupled, said first and second vibrating panels on said pair of first and second vibrating panel modules are mounted via said mounting holes by locking screws respectively.

9. A method of manufacturing a vibrating panel device for an electromagnetic vibrator, comprising the steps of: (a) putting a suspension and a vibrating panel into a base mold, integrating by insert molding to form a vibrating panel module, wherein an inner edge and an outer edge of the suspension are respectively connected with the vibrating panel and base so as to form an integrated whole body; and (b) mounting a pair of said vibrating panel modules in opposite directions by inverting one of said vibrating panel modules and coupling-bases of said vibrating panel modules with each other, while said suspensions are oriented in opposite directions, so as to form a vibrating panel device, wherein each of said bases comprises a button and a button hole, wherein when said buttons are coupled with said button holes, said bases are coupled with each other.

10. The method, as recited in claim 9, wherein said vibrating panels are rigid panels and said suspensions are made of flexible material, wherein in the step (a), said first suspension is molded-injected between said base and said vibrating panel that said suspension is integrally extended from said base to said vibrating panel to cover on an upper surface of said base and an upper surface of said vibrating panel to form the integrated whole body.

11. The method, as recited in claim 10, wherein said button is mounted on a first side bottom of each of said bases, and said button hole is mounted on a second side bottom of each of said bases, which is opposite to said first side bottom surface for coupling with said button, in such a manner when a pair of said vibrating panel modules is coupled, by rotating one of said vibrating panel modules for 180 degrees, said buttons and said button holes are fixedly coupled.

12. The vibrating panel device, as recited in claim 11, wherein at least one mounting hole is provided on each of said vibrating panels, wherein when a pair of said vibrating panel modules is coupled, said vibrating panels on said pair of vibrating panel modules are mounted via said mounting holes by locking screws respectively.

13. The method, as recited in claim 9, wherein said button is mounted on a first side bottom of each of said bases, and said button hole is mounted on a second side bottom of each of said bases, which is opposite to said first side bottom surface for coupling with said button, in such a manner when a pair of said vibrating panel modules is coupled, by rotating one of said vibrating panel modules for 180 degrees, said buttons and said button holes are fixedly buckled.

14. The vibrating panel device, as recited in claim 13, wherein at least one mounting hole is provided on each of said vibrating panels, wherein when a pair of said vibrating panel modules is coupled, said vibrating panels on said pair of vibrating panel modules are mounted via said mounting holes by locking screws respectively.

15. The vibrating panel device, as recited in claim 9, wherein at least one mounting hole is provided on each of said vibrating panels, wherein when a pair of said vibrating panel modules is coupled, said vibrating panels on said pair of vibrating panel modules are mounted via said mounting holes by locking screws respectively.

16. A method of manufacturing a vibrating panel device for an electromagnetic vibrator, comprising the steps of: (a) putting a suspension and a vibrating panel into a base mold, integrating by insert molding to form a vibrating panel module, wherein an inner edge and an outer edge of the suspension are respectively connected with the vibrating panel and base so as to form an integrated whole body; and (b) mounting a pair of said vibrating panel modules in opposite directions by inverting one of said vibrating panel modules and coupling bases of said vibrating panel modules with each other, while said suspensions are oriented in opposite directions, so as to form a vibrating panel device;

wherein said vibrating panels are rigid panels and said suspensions are made of flexible material, wherein in the step (a), said suspension is molded-injected between said base and said vibrating panel that said suspension is integrally extended from said base to said vibrating panel to cover on an upper surface of said base and an upper surface of said vibrating panel to form the integrated whole body;

wherein at least one mounting hole is provided on each of said vibrating panels, wherein when a pair of said vibrating panel modules is coupled, said vibrating panels on said pair of vibrating panel modules are mounted via said mounting holes by locking screws respectively.

* * * * *